United States Patent [19]

Saunders

[11] Patent Number: 4,720,919

[45] Date of Patent: Jan. 26, 1988

[54] TREE STAND BOW SIGHT

[76] Inventor: Charles A. Saunders, P.O. Box 476, Industrial Site, Columbus, Nebr. 68601-0476

[21] Appl. No.: 925,158

[22] Filed: Oct. 31, 1986

[51] Int. Cl.[4] ..... F41G 1/40

[52] U.S. Cl. ..... 33/265

[58] Field of Search ..... 33/265, 345, 346, 344, 33/396, 283

[56] References Cited

U.S. PATENT DOCUMENTS

| | | | |
|---|---|---|---|
| 1,477,545 | 12/1923 | Day | 33/354 |
| 1,607,881 | 11/1926 | Dunlea | 33/354 X |
| 2,924,022 | 2/1960 | Callahan | 33/340 |
| 2,925,656 | 2/1960 | Genovese | 33/265 |
| 2,933,821 | 4/1960 | D'Enis | 33/345 |
| 3,013,336 | 12/1961 | Pennington | 33/265 |
| 4,120,096 | 10/1978 | Keller | 33/265 |
| 4,580,349 | 4/1986 | Webb et al. | 33/265 |
| 4,616,422 | 10/1986 | Gaddy | 33/265 |

FOREIGN PATENT DOCUMENTS

| | | | |
|---|---|---|---|
| 24415 | 3/1911 | United Kingdom | 33/345 |

*Primary Examiner*—Harry N. Haroian

*Attorney, Agent, or Firm*—Michael G. Berkman

[57] ABSTRACT

An archery bow sight adapted for tree stand use and of the type which includes a pendulum-like element which is pivotal about a support shaft in response to changes in bow attitude, including angular disposition of the bow. The bow sight is characterized in that there is provided a motion-damping assembly for reducing the time duration of oscillation of the pendulum-like or pendulous element and the sight connected thereto as the pendant body seeks a stable rest position correlated with a given elected and selectable bow orientation. The desired damping may be achieved by any of several types of effective mechanisms and techniques including a damping arm or vane impeded by a fluid medium, magnetic friction forces, and dash pot arrangements.

22 Claims, 12 Drawing Figures

206
200
214
56
90
60
216
226
110
106
82
80
86
54
70
74
130
204
212
224
220
250
94
124
102
100
120
126
66
64
144
140
240
244
150
190
166
168
184
180
174
154
158
172
320
8
210
324
336
24
330
102
120
338
56
124
90
94
220
216
234
6
168
180
174
184
190
166
172
156
160
150

TREE STAND BOW SIGHT

BACKGROUND OF THE INVENTION

This invention relates to a sighting device for an archery bow. More particularly, the invention is directed to a bow sight having utility for use as a tree stand bow sight. The bow sight includes a frame adapted for attachment to a bow at the window section of the bow, and, as so attached, may be used selectively for tree stand use or, alternatively, while hunting on the ground.

Many types of sighting devices for bows, including bow sights for use in tree stands are known in the art. Sighting devices of the type referred to include a pendulum-like arm or pendulous element which is pivotal to assume a vertically directed disposition irrespective of the angular tilt or elevation of the bow. In the structures referred to, the sighting element itself is attached to, for movement with, the pivoting arm or pendulum. Conventionally, the sighting component includes mechanisms by which both elevation and lateral corrections and adjustments may be readily made.

A fundamental requirement of the sight supports utilized in tree stand bow sights is that the bead sight element itself be supported on an arm which is freely pivotal to assume a vertical direction irrespective of the angular shift imposed upon the bow itself. The fact that the pivotally supported element is free to swing arcuately on a supporting horizontally disposed shaft establishes a situation in which the suspended element undergoes oscillatory swinging movement until it finally comes to a rest position. The "collapsing" oscillations do take place over a finite time period so that there are objectionable delays before a stable sighting system has been established. It will be appreciated that such delays may often be crucial and may spell the difference between being able to release a timely arrow or being delayed to an extent that the "opportunity" is lost.

While it has long been recognized and appreciated that the elimination of this delay period would be a highly desirable goal, no tree stand bow sights have, heretofore, been devised which provide a solution to this vexing problem. It is, therefore, the aim of the present invention to provide an efective solution to the problem of the "swinging" bow sight so that sighting delays may be eliminated and the efficacy of bowhunting be enhanced.

BRIEF DESCRIPTION OF THE INVENTION

It is a principal object of this invention to provide an improved tree stand bow sight in which prior art shortcomings have been eliminated.

A related object of the invention is to provide a tree stand bow sight in which swinging or oscillatory motion of the sight-carrying arm has been minimized and the time of oscillation has been markedly reduced.

Another object of the invention is to provide a tree stand bow sight having a preadjusted sighting element which may be readily calibrated to provide a marked degree of accuracy over an extended sighting range.

It is a feature of the tree stand bow sight of the invention that as the target approaches the tree stand, necessitating further depression of the arrow trajectory, the sight is moved up, since correction for the gravitational force upon the arrow is reduced.

Another important object of the invention is to provide, in a tree stand bow sight, adjustment mechanisms by which the sight settings for both elevation and lateral correction may be quickly and conveniently achieved, and in which the selected settings are secure and reliably stable.

It is a feature of the bow sight of the invention that it includes simple and effective means by which the bow sight may be conveniently and readily attached to any standard bow, and may be easily removed, without the use of special tools.

Yet another object of the invention is to provide, in a tree stand bow sight, a structure which will ensure both effective range adjustment and lateral deflection or veerage compensation, and in which the archer may conveniently preset the ranges to his preferred values.

Yet another feature of the invention is that the tree stand bow sight may, optionally, be locked so as to provide a bow sight which is convenient for use for shooting on the ground or on level terrain.

It is a general feature of the improved bow sights of the invention that they include pivotally supported sight-carrying arms, the oscillations of which are damped to bring the arm quickly and reliably to a final rest position.

A general object of the invention is to provide a bow sight mechanism which is durable in construction, and reliable in use.

Other and further objects, features and advantages of the invention will become apparent from a reading of the following specifications considered in conjunction with the drawings.

DETAILED DESCRIPTION OF THE PREFERRED EMBODIMENT

The aims and objects of the invention are accomplished by providing in an archery bow sight adapted for tree stand use and which includes a pendulum-like sight-carrying element pivotally mounted on a support shaft for swinging motion in response to changes in bow attitude or elevation, and mechanisms for damping the pivotally supported arm so as markedly to reduce the time duration of oscillation of the pendulum and the sight connected thereto. It is an important feature of the invention that the damping mechanism provided accelerates the assumption, by the swinging pendulous element, of a stable rest position correlated with a given elected and selectable bow orientation.

It is a feature of the invention that the desired damping is achieved by any of several types of highly effective mechanisms and techniques. In one embodiment of the invention there is provided a pivotally supported leg or vertical strut which extends downwardly into, to be damped by movement through a fluid medium contained in a reservoir of the bow sight. In another embodiment of the invention there is provided an outrigger, arm-carried wing which contacts to bear upon a fluid contained in the reservoir in the bow sight. A baffle within the liquid medium itself ensures a certain degree of "stability" to the movement of the fluid within the reservoir.

In yet another damping arrangement, interacting magnetic and/or magnet-response elements are disposed to act upon, respectively, the pendulous element and the supporting bow sight housing, or between the pendulous element and the sight-carrying arm so as to establish magnetic friction between the relatively moving components and to damp oscillatory motion of the sight bead carrying assembly. It is within the present inventive concept to utilize damping mechanisms which include piston and cylinder fluid-flow dash pot assemblies as means to achieve damping of sighting bead motion derived from the combined action of gravity and momentum.

In accordance with the practice of the invention any swinging movement imparted to the pivotally-supported arm which carries the sight mechanism is rapidly dissipated and the sight assembly brought to a positive fixed orientation. Such prompt stabilization occurs each time the bow is moved through a vertical plane in sighting on a target. Objectionable delays in establishing a reliable sighting attitude are eliminated, and a more reliable and accurate hunting climate is assured.

Figure 1:
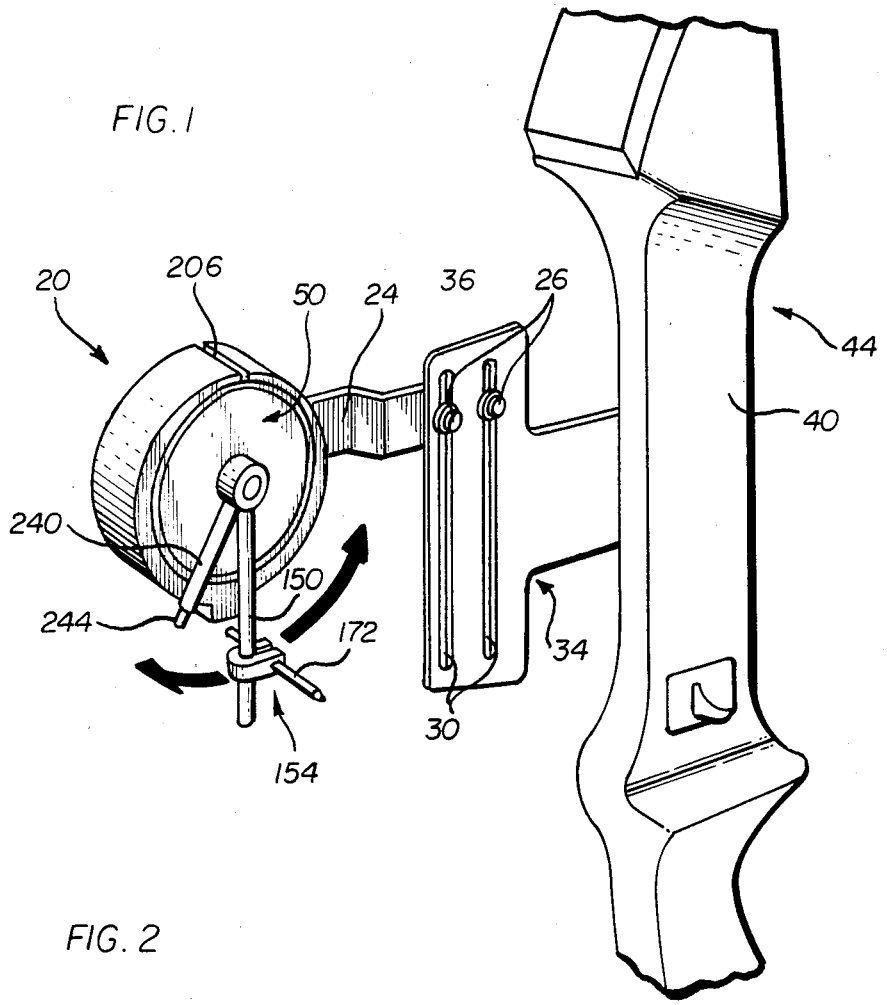
FIG. 1 is a perspective view of a tree stand bow sight, in accordance with the present invention, and fastened in place on a bow.
Figure 2:
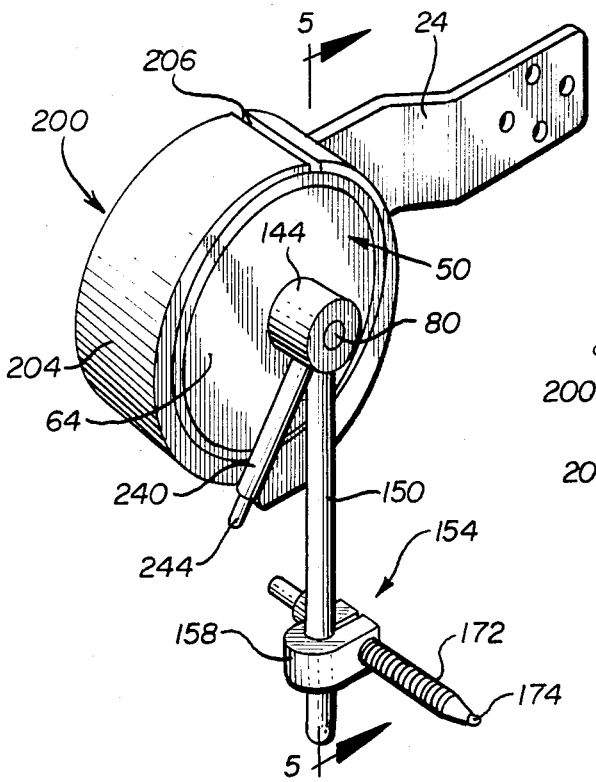
FIG. 2 is a perspective view of the bow sight of FIG. 1 and with the sight supported in a freely pivotal, nonrestrained functional mode.

Referring now to the drawing, and particularly to FIGS. 1 through 4, there is shown, for illustrative purposes and not in any limiting sense, a tree stand bow sight embodied as an assembly 20. As illustrated in FIG. 1, the bow sight 20 is carried on a flange 24 which is in turn secured by means of bolts 26 extending through elongated slots 30 formed in a mounting bracket 34 which is, in turn, fastened at a window zone 40 of a bow 44.

Figure 3:
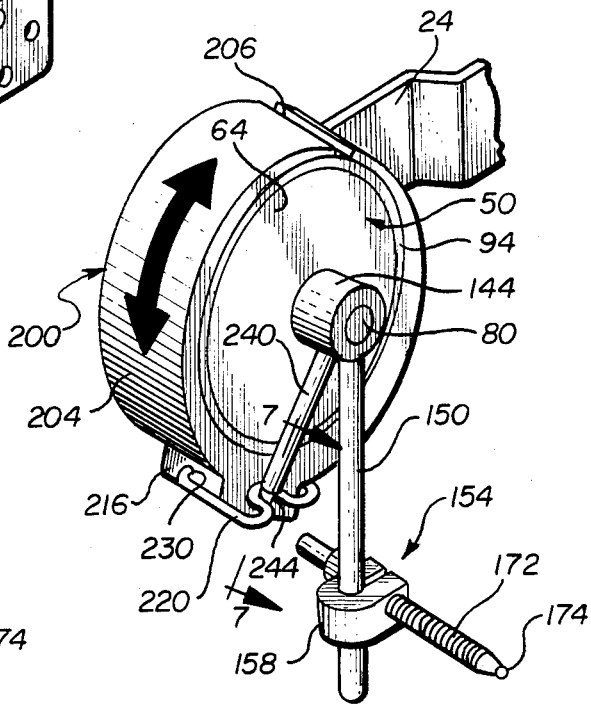
FIG. 3 is a view similar to that of FIG. 2 but showing the sight-carrying arm locked in a selectable, fixed position to facilitate using the bow sight when shooting on the ground.
Figures 4, 5, 6, 7:
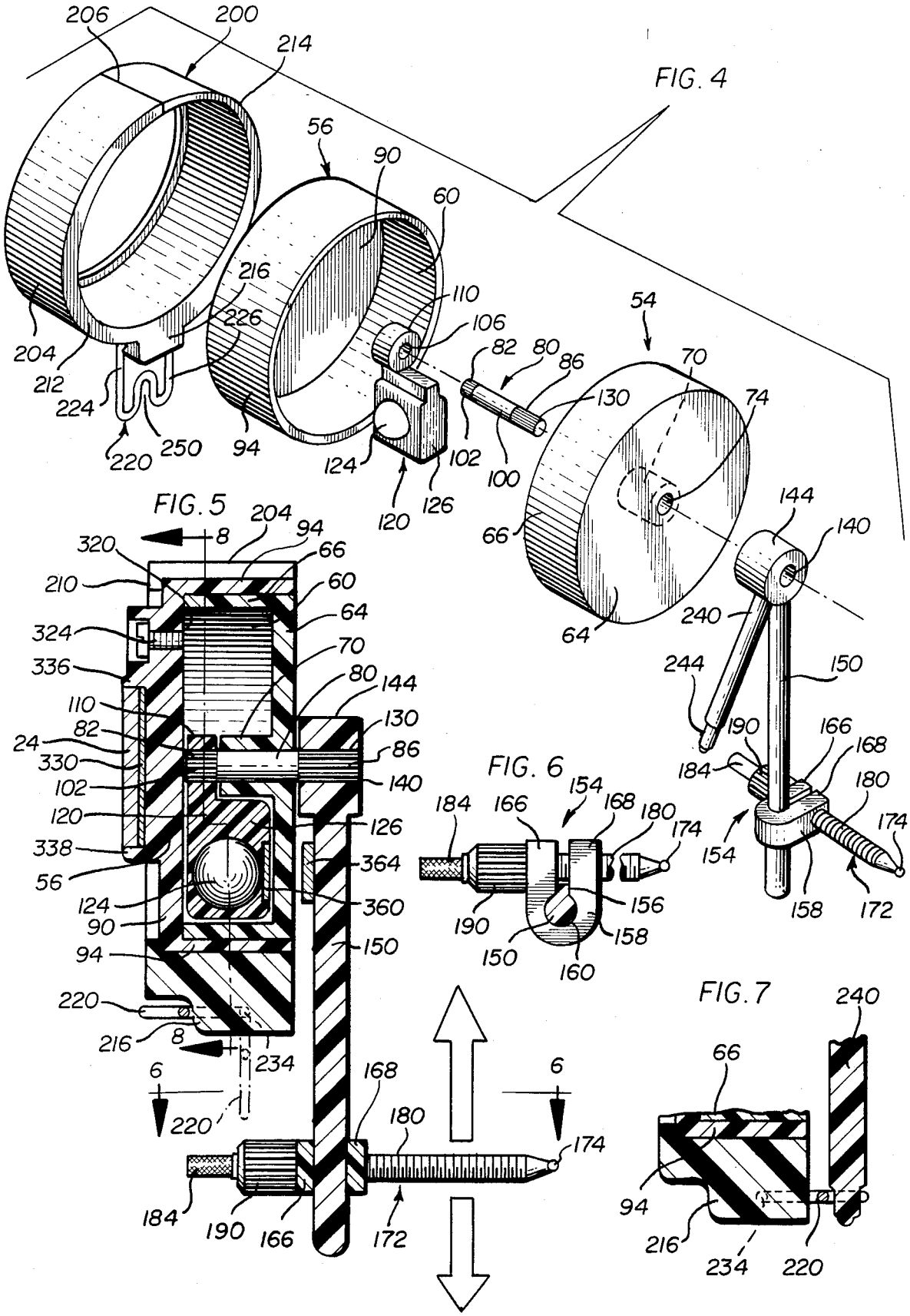
FIG. 4 is an exploded view of the bow sight of the invention, indicating schematically the arrangement and method of assembly of the component parts.
FIG. 5 is a cross-sectional view taken substantially on the lines 5—5 of FIG. 2 and showing a pivotally-supported sight arm and the arm-damping mechanism according to one embodiment of the invention.
FIG. 6 is a view taken substantially on the lines 6—6 of FIG. 5 and showing the sight element and structure by which the laterally-adjustable sight is secured for positioning, selectively, along the sight arm, and the mechanism for adjusting the sight bead for lateral correction.
FIG. 7 is a cross-sectional view taken substantially on the lines 7—7 of FIG. 3 and showing a detent restraining the movement of a locking arm which is coupled in turn to the sight-carrying arm, so as to facilitate using the bow sight during shooting on the ground.

As shown, and as best seen in the exploded view of FIG. 4, the bow sight assembly 20, in the embodiment depicted in FIGS. 1 through 8, includes a frame including a housing 50 formed by a pair of telescopically internesting open-ended dishes including an inner dish or cup 54 and an outer dish or cup 56 which, in their assembled configurations, define an interior cavity or reservoir 60 (FIG. 5). The inner cup 54 constitutes a circular base or end wall 64 integrally formed with a cylindrical, circumscribing wall 66. In a center zone the inner cup 54 is formed with an internal annular sleeve 70 defining a through bore 74 for rotationally supporting a shaft 80 having one end 82 within the cavity or reservoir 60 and its opposite end 86 extending axially outwardly from the reservoir 60. The outer dish or cup 56, dimensioned slidably and contiguously to receive therewithin the inner dish 54, includes a base 90 and an integrally-formed circumscribing cylindrical wall 94. In the assembled mode of the bow sight, the inner dish 54 is nested within the outer dish 56 in fluid-sealing engagement therewith to define the fluid reservoir 60.

As indicated schematically in FIG. 4, and as shown in FIG. 5, the shaft 80 which is rotationally supported at a central lineal zone thereof 100 in the bore 74 of the sleeve 70 is formed at its inwardly-directed end 82 with spline-like ribs 102 for lockingly engaging within a cooperating bore 106 formed in a hub 110 connected to, to support a pendulum strut or pendulous element 120 within the housing or cavity 60. In the particular embodiment of the invention shown in FIGS. 1 through 8, the pendulous element 120 carries a bearing-like metal ball 124 which serves as a weight confined in a block 126 at a freely-swinging end of the pendulous element 120. Also, as shown in FIG. 5, a magnetic element 360 may be attached to the pendulum, or the metal ball 124 of the pendulum 120, may itself be magnetic. In the arrangement described a cooperating magnet 364 is conveniently secured to the arm 150. In this embodiment of the invention the pendulum 120 and the arm 150 could both be free to rotate on the shaft 80. At its end 86 extending outwardly of the cavity 60 of the bow sight 20, the shaft 80 is formed with spline-like ribs 130 for grippingly and lockingly engaging within a cooperating bore 140 formed in a hub-like boss 144 to which is attached to depend therefrom an elongated arm 150 which carries a sight bead assembly 154. The arm 150 is feathered to define an elongated, integrally formed, coextensive rib 156 for preventing rotation of the sight bead assembly 154 on the arm 150. The sight bead assembly 154 which is slidably positionable, selectively, along the lineal expanse of the arm 150 includes a generally U-shaped yoke 158 which defines, at its looped end, a through opening 160 through which the arm 150 and the arm-carried rib 156 are slidable. The yoke 158 defines a pair of spaced, generally parallely disposed legs 166 and 168 formed with aligned through bores extending normally of the shaft 150 on which the yoke 158 is secured. A pin 172 carrying a sight bead 174 at one end is formed with threads 180 extending along its lineal expanse.

In the specific embodiment of the invention shown, the pin 172 projects through the bore in the first arm 166 of the yoke 158 and is threadedly engaged in cooperating threads formed in the second arm 168 of the yoke 158 so that rotation of the pin, manually, by digital force applied at a knurled 184 end section of the pin 172 serves to advance or retract the pin 172 and the sight bead 174 carried thereby so as to achieve lateral adjustment of the sighting mechanism. A locking nut 190 threadedly engaged on the threaded pin 172 serves the dual function of urging the opposed arms 166 and 168 of the yoke 158 toward one another so as lockingly to embrace the sight support shaft 150 and, at the same time, to lock the sighting pin in a selectable fixed position.

In the specific embodiment of the tree stand bow sight depicted, there is provided the capability of securing the sighting assembly 154 selectably fixed with respect to the bow sight assembly 20 so as to enable the hunter to use the bow sight for shooting on the ground or on the level terrain, should this option be elected. As shown, and with reference particularly to FIGS. 3 and 4, the structure by which this versatility is achieved includes a spring band or sheath 200 consisting of a band-like wall 204 generally cylindrical in form and provided with a slot 206 extending transversely, across the band 204 for allowing forced resilient deformation or radial enlargement of the band to permit telescoping entry of the outer dish 56 therewithin in a mode to establish frictional gripping engagement of the band 200 about the cylindrical wall 94 of the dish 56 so that the band 200 is rotatable and selectively positionable annularly with respect to the embraced outer dish 56 (FIG. 3). As shown in FIG. 4, and in FIG. 5, the spring band or sheath 200 is integrally formed with a radially inwardly extending annular edge flange 210 which serves as a limit stop upon slidably positioning the band 200 over the wall 94 of the dish 56. In the particular preferred embodiment of the invention illustrated, the resilient band 200 is of an inconstant thickness as measured radially transversely of the wall 204 so as to provide improved strength and the requisite degree of distortability and resilience. At its thickened zone 212 remote from an opposed thinned zone 214, in which the slot 206 is cut, the band 200 is integrally formed with a transversely extending cross bar 216 to which there is pivotally secured a spring wire clip 220, opposed, generally parallel arms 224 and 226 of the clip 220 being bent at their respective free ends to define probes 230 extending into cooperating bores 234 projecting into the bar 216 at opposed sides thereof.

Attached to to extend radially from the hub or boss 144 secured on the shaft end 86 is a locking bar 240 terminating at its free end in a finger 244, the latter being engageable within a spring loop constricted zone 250 defined by the pivotal clip 220 when the latter is swung on its hinge-like pivot probes 230 to extend in a plane generally paralleling the shaft 80 of the assembly, as shown in FIG. 3. In the arrangement described, the sighting assembly 154 is locked against swinging movement and is fixed with respect to the clamping band 200 and, accordingly, with respect to the mounting bracket 24. In the structure depicted in FIG. 3, the sighting assembly 154 may be repositioned, selectively, and in a fixed mode, merely by manually gripping the spring band or ring 200 and rotating the latter annularly about the outer dish 56. Thus, the tree bow sight of the invention may be conveniently used for shooting the bow on the ground or on level terrain. By simply disconnecting the spring clip 220 from the finger 244 of the locking rod 240, the bow sight is returned to a mode in which the sighting assembly is again pivotal, for convenient use as a tree stand bow sight.

Figure 8:
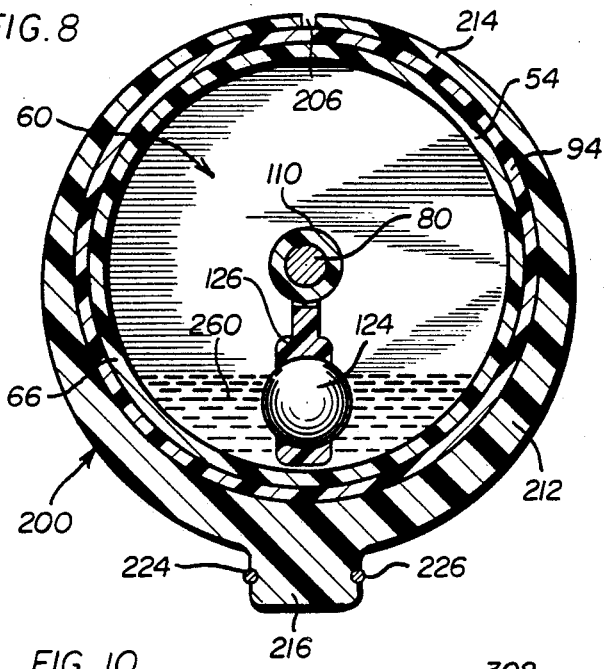
FIG. 8 is a cross sectional view taken substantially on the lines 8—8 of FIG. 5, and showing a weighted pendulum body projecting into a damping fluid confined in a chamber of the bow sight.

Each of the several embodiments of the present invention has in common as a definitive feature thereof a mechanism by which the swinging oscillation of the sight assembly 154 is damped so as to bring the sight bead 174 to a fixed sighting position, without objectionable delay. In the embodiment of the invention illustrated in FIGS. 4, 5, and 8, the damping is achieved through the intercooperation of the pendulous element 126 coupled to the sight assembly supporting an arm 150 and operative in a fluid medium 260 confined in the housing or reservoir 60 within the internesting dish-like cups 54 and 56 (FIG. 8). The fluid 260 which may be any of various suitable liquids is a temperature-stable relatively inert, somewhat viscous liquid such as a polyhydroxy organic compound, for example, glycerol. Other suitable fluids may include mercury, and oils and silicone fluids which meet the physical requirements of the system and the ambient environment in which the bow sight finds use. It is contemplated that the word "fluid" as used herein will encompass within its scope non-liquid materials such as fine globules of plastic which may fulfill the functional requirements of a damping "fluid" within the concept of the present invention. Irrespective of the particular "fluid" selected, the aims and objects of the invention are achieved through the use of a fluid medium which acts effectively to deter and damp the swinging or oscillatory motion of the pendant element 126 within the housing of the bow sight.

Figure 9:
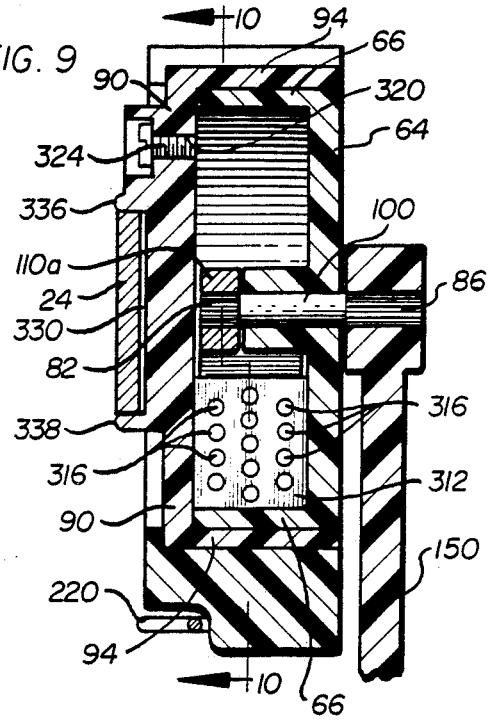
FIG. 9 is a cross-sectional view similar to that showin in FIG. 5 but illustrating an alternative form of a damping mechanism according to the present invention.
Figure 10:
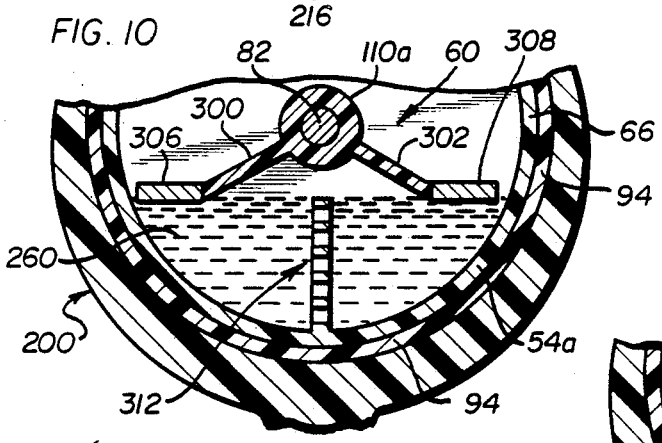
FIG. 10 is a fragmentary, cross-sectional view taken substantially on the lines 10—10 of FIG. 9 and showing an embodiment of the damping apparatus according to the invention, in which a baffle assembly includes outrigger floats or plates which bear upon a liquid contained in a chamber and in which a baffle is provided for controlling the movement of the liquid itself.

A second embodiment of the oscillation damping mechanism of the invention is depicted in FIGS. 9 and 10. As there shown, the hub **110*a* fastened on the end 82 of the shaft 80, interiorly of the housing or fluid reservoir carries a pair of laterally-outwardly-angled struts or outriggers 300 and 302 terminating at their respective outwardly directed ends in paddles, floats or plates 306 and 308 which contact and tend to float upon the fluid 260 confined in the interior of the bow sight. Excessive movement or "sloshing" of the fluid within the confining reservoir 60 is minimized by providing a baffle 312 which, in the particular embodiment of the invention depicted in FIG. 10 is shown as fastened to and extending upwardly from the interior of the wall 66 of the inner cup 54*a*. Through ports 316 in the baffle 312 enhance the effectiveness and operation of the baffle 312** itself.

In an alternative structural embodiment of the invention fluid baffles take the form of spaced platelets or vanes fastened to and extending radially inwardly of the cylindrical wall 66 interiorly of and about the annular expanse of the wall 66 in a zone adjacent the base 64 of the inner dish 54.

For convenience in introducing the fluid 260 into the bow sight after the latter has been assembled, there is provided a fluid inlet port 320 which, in the specific embodiment of the invention shown, extends through the planar wall 90 of the outer dish 56. The port 320 is threaded so that it may be effectively sealed by means of a correspondingly threaded cooperating screw 324. While any preferred technique and structure may be utilized for attaching the bow sight 20 to the carrying bracket 24, in the preferred embodiment of the invention illustrated, the bracket 24 is secured to the assembly, at the rear of the end wall 90 of the dish or cup 56 through the use of a suitable adhesive preparation 330 applied as a bonding interface. A pair of diminutive walls 336 and 338 integrally formed with and projecting normally of the wall 90 of the cup 56 at the rear thereof define physical abutments against which corresponding side edges of the bracket 24 bear, further to obviate relative displacement between the bracket 24 and the assembly to which it is fastened.

Figure 11:
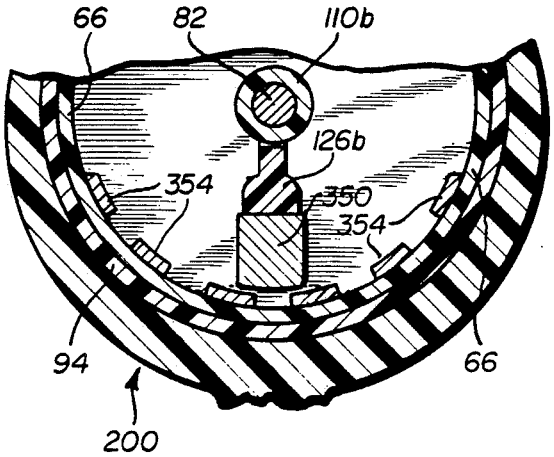
FIG. 11 is a fragmentary cross-sectional view of an embodiment of the invention in which the apparatus for effecting damping of the swinging motion of the sight includes intercooperating magnetic components.

Yet another technique by which damping of the swinging or oscillatory motion of the pendulous element and the sighting assembly attached thereto is achieved, in accordance with the present invention, is indicated in FIGS. 8 and 11. As shown, the pendulous element **126*b* attached to the shaft 82 by the hub 110*b* carries a magnet 350 at its lower free end presented toward the inner face of the cylindrical wall 66 of the inner cup 54. Fastened to to extend along an arcuate sector of the wall 66 interiorly of the cavity or housing of the assembly is a series of longitudinally-spaced, lineally-extending magnetic elements 354. It will be appreciated that in the arrangement described and depicted, any swinging or oscillatory motion of the pendulous element 126*b* will be effectively damped by the magnetic frictional force established between the magnetic element 350 on the pendulous device and the opposed magnets 354 secured to the arcuate wall 66 of the inner cup 54**.

In an alternative arrangement interacting cooperating magnetic elements may be attached one to the body of the bow sight at an outer face thereof and the other to the opposed swinging arm 150 which carries the sight pin 180 and bead 174.

Figure 12:
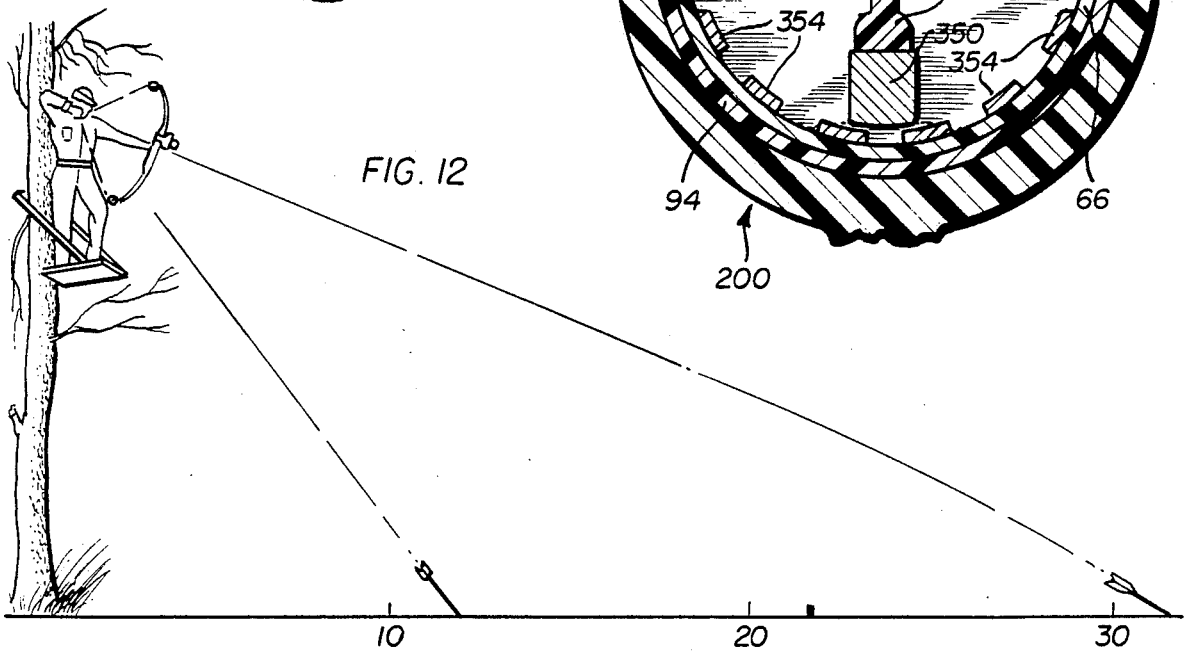
FIG. 12 is a sketch depicting schematically an archer's use of a tree stand bow sight, and indicating diagramatically a method for the direct range calibration of the tree stand bow sight.

Referring now briefly to FIG. 12, there is provided a schematic representation of a procedure for calibrating the tree stand bow sight of the invention for use. In order to ensure the correct bow sight setting for a target within the range of 10 yards to 30 yards the archer may shoot a group of arrows, from the tree stand, at a 30-yard target and a second group at a 10-yard target. The next step is to measure the distance between the "center" of the two groups of arrows. If this measured distance is greater than 20 yards, the sight pin should be moved upwardly on the supporting arm 150. If less than 20 yards, the sight pin supporting arm 180 carried on the yoke 158 should be moved downwardly. With the above operation completed and the arms setting corrected for a 20-yard distance between the two groups, it is necessary merely to reset the assembly up or down to bring the pin on the 30-yard target, as described in the initial procedure of grouping arrows at a 30-yard and at a 10-yard target. Other preferred procedures for "zeroing" or calibrating the tree stand bow sight may be used, all as described in the art.

While the present invention has been described with reference to preferred embodiments, it is obvious that numerous changes may be made in the size, shape, details and arrangements of the various elements of the invention without departing from the scope and spirit thereof. For example, while the use of plastics materials for the major components of the bow sight is preferred, other materials including light-weight metallic alloys may be employed. Additionally, in the light of the present disclosure, alternative arrangements for achieving the damping of the sight-carrying assembly may occur to those skilled in the art. It is, therefore, intended to include within the appended claims all such variations and modifications which fall within the spirit and scope of the invention.

What is claimed is:

1. A bow sight for tree-stand archery use, said bow sight comprising bracket means for attachment of said bow sight to an archery bow, and means securing said bracket means to said bow sight, frame means including wall means of said bow sight defining a drum-like chamber for housing a pendulous element therein, shaft means and means securing said shaft means to extend into said chamber, a pendulous element mounted on said shaft means interiorly of said chamber for swinging arcuate movement there within, sight means for sighting on a target, means including arm means interconnecting said sight means to said pendulous element for pivotal movement therewith, and damping means for acting on said pendulous element for enhancing attenuation of arcuate movement of said element initiated by angular rotational repositioning of the bow during sighting on a target, band means grippingly embracing said wall means of said chamber exteriorly thereof and being rotational for selective annular orientation of said band means with respect to said wall means of said chamber, locking means affixed to and carried by said band means for securing said sight means in selectable positions with reference to and against movement with respect to said wall means of said chamber, for facilitating optional use of said bow sight for shooting on the ground.

2. The improvement as set forth in claim 1 wherein said damping means comprises reservoir means carried by said frame means for retaining a damping medium therein, said damping medium comprising fluid means confined within said reservoir means and operative to establish resistance to free movement of said arm means and said sight means carried thereby, and further comprising outrigger means fastened to and extending laterally of said shaft means and present to for engaging said fluid means for abating oscillatory movement of said shaft-carried arm means and said sighting means attached thereto during shifting of the bow about a generally horizontal axis in sighting on a target.

3. The structure as set forth in claim 1 wherein said damping means comprises fluid means confine within said chamber and operative to engage said pendulous element extending into said fluid means to restrain swinging movement of said pendulous element and of said sight means coupled thereto.

4. The improvement as set forth in claim 2 wherein said fluid means includes a polyhydroxy alcohol.

5. The improvement as set forth in claim 1 and further comprising weight means attached to and carried by said pendulous element for directing said pendulous element and said arm-carrying sight means to a gravity-induced final rest point.

6. The structure as set forth in claim 2 wherein said outrigger means includes a pair of opposed laterally outwardly extending paddle-like plates for engaging said fluid means contained in said reservoir means.

7. The improvement as set forth in claim 2 and further comprising baffle means, and means supporting said baffle means within said fluid means in said reservoir means for deterring unrestrained movement of said fluid means with respect to said reservoir means during rotational displacement of said bow sight about a generally horizontal axis.

8. The improvement as set forth in claim 1 wherein said damping means comprises first magnetic means and means securing said first magnetic means to said pendulous element for travel therewith, second magnetic means and means securing said second magnetic means to said bow sight to extend along a locus juxtaposed to an oscillatory travel path of said first magnetic means of said pendulous element for establishing magnetic friction forces between said first and said second magnetic means for quelling oscillatory movement of said arm means.

9. The improvement as set forth in claim 1 and further comprising locking means for securing said arm means and said sight means connected thereto fixed for facilitating optional use of said sight means for shooting on the ground.

10. The structure as set forth in claim 9 wherein said locking means comprises detent means including means for restraining said arm means against swinging movement with respect to said frame means.

11. The structure as set forth in claim 10 and further comprising band means embracing said bow sight exteriorly thereof and being shiftable annularly about said bow sight, said band means constituting support means for said detent means attached thereto, and constituting means for establishing selective orientational fixed positioning of said arm means and said sight means attached thereto during use of said bow sight during shooting on the ground.

12. The structure as set forth in claim 11 and further comprising locking rod means and means connecting said locking rod means to said shaft means for rotational displacement therewith, said locking rod means constituting means for engaging said detent means to lock said arm means and said sight means connected thereto against annular displacement with respect to said frame means of said bow sight.

13. The structure as set forth in claim 9 wherein said locking means is selectively positionable between a first position permitting free rotation of said sight means with respect to said frame means, and a second, locking position in which said sight means is physically restrained against rotational movement about said shaft means.

14. The structure as set forth in claim 11 wherein said band means is of an inconstant wall thickness about its peripheral expanse and is formed with a transverse slit extending through said band means and across the width thereof.

15. The structure as set forth in claim 14 wherein said band means has a through thickness which is maximum in an annular zone thereof diametrically opposed to said slit formed in said band means.

16. The structure as set forth in claim 14 and further comprising flange means integrally formed with and projecting radially inwardly of said band means along an edge thereof, said flange means constituting a limiting stop for said frame means of said bow sight upon insertion of said frame means slidably into said band means.

17. The structure as set forth in claim 1 and further comprising mounting means for supporting said sight means on said arm means, said mounting means including clamping means and means for urging said clamping means to grip and lock upon said arm means at selectable positions therealong.

18. The structure as set forth in claim 17 and further comprising means for selectively positioning said sight means along a path generally normally of said arm means for lateral sight corrections.

19. The improvement as set forth in claim 1 and further comprising means coupling said sight means to said damping means, and wherein said damping means comprises wall means defining a chamber within said bow sight, said chamber constituting fluid reservoir means for retention of a damping fluid therein, fluid means in said reservoir means for damping motion of a pendulous element in contact therewith, said pendulous element having an end portion thereof distal from said shaft means and in physical contact with said fluid means, and wherein damping said pendulous element is operative to effect damping in movement of said sight means.

20. The structure as set forth in claim 1 and further comprising rib means integrally formed with said arm means and extending longitudinally therealong for preventing rotation of said sight means about said arm means.

21. The structure as set forth in claim 3 wherein said fluid means is mercury.

22. A bow sight for tree-stand archery use, said bow sight comprising bracket means for attachment of said bow sight to an archery bow, and means securing said bracket means to said bow sight, wall means of said bow sight defining a drum-like chamber for housing a pendulous element therein, shaft means and means securing said shaft means to extend into said chamber, a pendulous element mounted on said shaft means interiorly of said chamber for swinging arcuate movement therewithin, sight means for sighting on a target, means interconnecting said sight means to said pendulous element for pivotal movement therewith, and damping means for acting on said pendulous element for enhancing attenuation of arcuate movement of said pendulous element initiated by angular rotational repositioning of the bow during sighting on a target, said chamber including a pair of internesting, open-faced dishes having planar bases and circumscribing cylindrical walls, said dishes including an outer and an inner dish, said inner dish being dimensioned diametrically for telescoping entry of an open end thereof axially into said outer dish for contiguous wall-sealing interengagement therewith to define said chamber, sleeve bearing means for supporting said shaft means within said chamber, and means securing said sleeve bearing means to a planar base of one of said dishes, interiorly thereto, to project from said planar base at a center zone thereof, said shaft means extending through said bearing means to an interior zone of said chamber and carrying said pendulous element attached to said shaft means adjacent an end thereof within said chamber, said shaft means having an opposite end projecting outwardly of said chamber, and wherein said means interconnecting said sight means to said pendulous element includes arm means attached to said opposite end of said shaft means and projecting normally thereof.

* * * * *